US010553929B2

(12) United States Patent
Patel et al.

(10) Patent No.: US 10,553,929 B2
(45) Date of Patent: Feb. 4, 2020

(54) TRACKING ANTENNA SYSTEM HAVING MODULAR THREE-AXES PEDESTAL

(71) Applicant: Sea Tel, Inc., Concord, CA (US)

(72) Inventors: Trushar D. Patel, Hercules, CA (US); Tuncer Ede, Pittsburg, CA (US)

(73) Assignee: Sea Tel, Inc., Concord, CA (US)

( * ) Notice: Subject to any disclaimer, the term of this patent is extended or adjusted under 35 U.S.C. 154(b) by 0 days.

(21) Appl. No.: 16/020,166

(22) Filed: Jun. 27, 2018

(65) Prior Publication Data

US 2018/0375188 A1 Dec. 27, 2018

Related U.S. Application Data

(60) Provisional application No. 62/525,701, filed on Jun. 27, 2017.

(51) Int. Cl.

| | |
|---|---|
| ***H01Q 3/02*** | (2006.01) |
| ***H01Q 1/12*** | (2006.01) |
| ***H01Q 3/08*** | (2006.01) |
| ***H01Q 1/18*** | (2006.01) |
| ***H01Q 1/34*** | (2006.01) |
| *H01Q 1/08* | (2006.01) |
| *H01Q 3/18* | (2006.01) |

(52) U.S. Cl.

CPC ..... *H01Q 1/1264* (2013.01); *H01Q 1/18* (2013.01); *H01Q 1/34* (2013.01); *H01Q 3/08* (2013.01); *H01Q 1/08* (2013.01); *H01Q 1/125* (2013.01); *H01Q 3/18* (2013.01)

(58) Field of Classification Search

CPC ..... H01Q 1/125; H01Q 1/08; H01Q 3/08; H01Q 1/34; H01Q 3/18

USPC ..... 343/882, 765, 766, 709, 757, 758, 881

See application file for complete search history.

(56) References Cited

U.S. PATENT DOCUMENTS

| | | | | |
|---|---|---|---|---|
| 5,419,521 | A | 5/1995 | Matthews | |
| 6,725,784 | B2 | 4/2004 | Crinion | |
| 8,542,156 | B2 | 9/2013 | Patel | |
| 9,000,995 | B2 | 4/2015 | Blaney | |
| 9,466,889 | B2 | 10/2016 | Patel | |
| 2008/0258988 | A1* | 10/2008 | Son | H01Q 1/125 343/765 |
| 2008/0297427 | A1 | 12/2008 | Jung et al. | |
| 2010/0149059 | A1 | 6/2010 | Patel | |
| 2012/0001816 | A1 | 1/2012 | Blaney | |
| 2015/0222024 | A1 | 8/2015 | Patel | |
| 2015/0236397 | A1 | 8/2015 | Son et al. | |

* cited by examiner

*Primary Examiner* — Joseph J Lauture

(74) *Attorney, Agent, or Firm* — Santa Fe IP, LLC

(57) ABSTRACT

A modular three-axes antenna pedestal includes: an azimuth frame rotatably mounted about an azimuth axis, the azimuth frame having an azimuth beam and a post releasably mounted to the azimuth beam; an azimuth driver rotating the azimuth frame about the azimuth axis; a cross-level frame pivotally mounted on the azimuth frame to pivot about a cross-level axis; a cross-level driver pivoting the cross-level frame relative to the azimuth frame; an elevation frame supporting a tracking antenna, the elevation frame being pivotally mounted on the cross-level frame to pivot about an elevation axis; and an elevation driver pivoting the elevation frame relative to the cross-level frame. A method of using the modular three-axes antenna pedestal is also disclosed.

21 Claims, 13 Drawing Sheets

TRACKING ANTENNA SYSTEM HAVING MODULAR THREE-AXES PEDESTAL

CROSS-REFERENCES TO RELATED APPLICATIONS

This application claims priority to U.S. Provisional Patent Application No. 62/525,701 filed Jun. 27, 2017 and entitled TRACKING ANTENNA SYSTEM HAVING MODULAR THREE-AXES PEDESTAL, the entire contents of which is incorporated herein for all purposes by this reference.

BACKGROUND OF INVENTION

Field of Invention

This application relates, in general, to tracking antenna systems, and more particularly to modular three-axes pedestals for tracking antennae and methods for their use.

Description of Related Art

Three-axes tracking antennae are especially suitable for use aboard ships and other mobile applications. Such tracking antennae operate to track radio frequency transmitters such as communications satellites, notwithstanding roll, pitch, yaw, and turn motions of a ship at sea. Tracking antennae used in shipboard satellite communication terminals typically are highly directive. For such tracking antennae to operate effectively they must be pointed continuously and accurately in the direction toward a satellite.

When a ship changes its geographical position, or when the satellite changes its orbital position, and when the ship rolls, pitches, yaws and turns, a tracking antenna mounted on the ship must be redirected accounting for such motions. Accordingly, three-axes pedestals are essential to allow for necessary degrees of freedom to maintain its orientation with respect to a satellite. Exemplars of prior three-axes pedestals are shown in U.S. Pat. Nos. 9,000,995 to Blaney, 8,542,156 to Patel, and 5,419,521 to Matthews.

Compactness in size and lightness in weight are of paramount importance for antenna pedestals used on ships. However, tracking antennae are often of such weight that during installation the use of cranes and/or other lifting devices are necessary to safely install them, especially when such antennae are mast mounted.

It would therefore be useful to provide a tracking antenna having a modular three-axes pedestal which overcomes the above and other disadvantages of known tracking antenna.

BRIEF SUMMARY

One aspect of the present invention is directed to a modular three-axes antenna pedestal for supporting a tracking antenna including: a base assembly; an azimuth frame rotatably mounted on the base assembly to rotate about an azimuth axis, the azimuth frame including an extruded azimuth beam, a post having an extruded upright beam, and an azimuth bracket releasably mounting the post to a rear end of the azimuth beam; a cross-level frame pivotally mounted on the azimuth frame to pivot about a cross-level axis; an elevation frame supporting the tracking antenna and pivotally mounted on the cross-level frame to pivot about an elevation axis; a motion platform assembly mounted on the elevation frame to move with the elevation frame and the tracking antenna, wherein the motion platform senses the position and movement the antenna assembly with respect to the earth's gravity vector; and a pedestal control unit (PCU) mounted on the azimuth frame for processing signals from the motion platform to control movement of the tracking antenna about the azimuth, cross-level and elevation axis.

A quick-release fastener may releasably secure the azimuth bracket to one of the post and the azimuth beam.

The cross-level frame may include an extruded cross beam.

The cross-level frame may further include a pair of extruded diverging arms extending from opposing ends of the cross beam, a pair of cross-level brackets releasably securing the diverging arms to the opposing ends of the cross beam, a pair of bearing blocks mounted on respective terminal ends of the diverging arms, the bearing blocks being releasably secured to the terminal ends of the diverging arms.

The cross-level frame may include a hub, a pair of extruded diverging arms extending from opposing ends of the hub, and a pair of bearing blocks mounted on respective terminal ends of the diverging arms.

The modular three-axes antenna pedestal may further include: an azimuth driver for rotating the azimuth frame relative to the base assembly, the azimuth driver being mounted on the azimuth frame, the azimuth driver including an azimuth motor driving an azimuth belt entrained around an azimuth gear rotationally affixed to the base assembly; a cross-level driver for pivoting the cross-level frame relative to the azimuth frame, the cross-level driver being mounted on the post of the azimuth frame, the cross-level driver including a cross-level motor driving a cross-level belt entrained around a cross-level gear rotationally affixed to the cross-level frame; and an elevation driver for pivoting the elevation frame relative to the cross-level frame, the elevation driver being mounted on the elevation frame, the elevation driver including an elevation motor driving an elevation belt entrained around an elevation gear rotationally affixed to the cross-level frame.

The PCU may process signals from the motion platform to control the azimuth, cross-level and elevation drivers for controlling movement of the tracking antenna about the azimuth, cross-level and elevation axis.

The modular three-axes antenna pedestal may further include a removable communications line for interconnecting the motion platform and the electronics assembly.

The post may further include an extruded vertical beam interconnecting a lower end of the inclined beam to the rear end of the azimuth beam of the azimuth frame, and a post bracket releasably mounting the vertical beam to the inclined beam.

Another aspect of the present invention is directed to a modular three-axes antenna pedestal for supporting a tracking antenna including: a base assembly; an azimuth frame rotatably mounted on the base assembly to rotate about an azimuth axis, the azimuth frame including an azimuth beam, a post having an upright beam, and an azimuth bracket releasably mounting the post to a rear end of the azimuth beam; an azimuth driver for rotating the azimuth frame relative to the base assembly, the azimuth driver being mounted on the azimuth frame, the azimuth driver including an azimuth motor driving an azimuth belt entrained around an azimuth gear rotationally affixed to the base assembly; a cross-level frame pivotally mounted on the azimuth frame to pivot about a cross-level axis, the cross-level frame including a cross-level member, a pair of diverging arms extending from opposing ends of the cross-level member; a cross-level driver for pivoting the cross-level frame relative to the azimuth frame, the cross-level driver being mounted on the post of the azimuth frame, the cross-level driver including a cross-level motor driving a cross-level belt entrained around a cross-level gear rotationally affixed to the cross-level frame; an elevation frame supporting the tracking antenna and pivotally mounted on the cross-level frame to pivot about an elevation axis; and an elevation driver for pivoting the elevation frame relative to the cross-level frame, the elevation driver being mounted on the elevation frame, the elevation driver including an elevation motor driving an elevation belt entrained around an elevation gear rotationally affixed to the cross-level frame.

A quick-release fastener may releasably secure the azimuth bracket to one of the post and the azimuth beam.

The azimuth beam may be an extruded azimuth beam, and the upright beam may be an extruded upright beam.

The post may further include a vertical beam, wherein the upright beam is substantially vertical and interconnects a lower end of the inclined beam to the rear end of the azimuth beam of the azimuth frame, and a post bracket releasably mounting the upright beam to the inclined beam.

The vertical beam may be an extruded vertical beam.

The cross-level member may be an extruded cross beam, and the pair of diverging arms may be extruded diverging arms.

The cross-level frame may further include a pair of cross-level brackets releasably securing the diverging arms to the opposing ends of the cross beam.

The cross-level frame may further include a pair of bearing blocks mounted on respective terminal ends of the diverging arms, the bearing blocks being releasably secured to the terminal ends of the diverging arms.

The modular three-axes antenna pedestal may further include: a motion platform assembly mounted on the elevation frame to move with the elevation frame and the tracking antenna, wherein the motion platform senses the position and movement the antenna assembly with respect to the earth's gravity vector; and a pedestal control unit (PCU) mounted on the azimuth frame for processing signals from the motion platform to control movement of the tracking antenna about the azimuth, cross-level and elevation axis.

The PCU may process signals from the motion platform to control the azimuth, cross-level and elevation drivers for controlling movement of the tracking antenna about the azimuth, cross-level and elevation axis.

The modular three-axes antenna pedestal may further include a removable communications line for interconnecting the motion platform and the electronics assembly.

Yet another aspect of the present invention is directed to a method of installing a tracking antenna including a radome removably mounted on a radome base and a modular three-axes antenna pedestal also mounted on the radome base, the modular three-axes antenna pedestal including: an azimuth frame rotatably mounted on the radome base to rotate about an azimuth axis, the azimuth frame including an azimuth beam, a post releasably mounting to the azimuth beam; an azimuth driver for rotating the azimuth frame relative to the radome base, the azimuth driver being mounted on the azimuth frame, the azimuth driver including an azimuth motor driving an azimuth belt entrained around an azimuth gear rotationally affixed with respect to the radome base; a cross-level frame pivotally mounted on the azimuth frame to pivot about a cross-level axis, the cross-level frame; a cross-level driver for pivoting the cross-level frame relative to the azimuth frame, the cross-level driver being mounted on the post of the azimuth frame, the cross-level driver including a cross-level motor driving a cross-level belt entrained around a cross-level gear rotationally affixed to the cross-level frame; an elevation frame supporting the tracking antenna and pivotally mounted on the cross-level frame to pivot about an elevation axis; and an elevation driver for pivoting the elevation frame relative to the cross-level frame, the elevation driver being mounted on the elevation frame, the elevation driver including an elevation motor driving an elevation belt entrained around an elevation gear rotationally affixed to the cross-level frame, the method including: removing the radome from the radome base; releasing the post from the azimuth beam, and removing the post, cross-level frame, elevation frame and tracking antenna from the radome base; mounting the radome base on an installation site; mounting the post on the azimuth beam at the installation site, thereby mounting the post, cross-level frame, elevation frame and tracking antenna on the radome base; and mounting the radome on the radome base at the installation site.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Generally, when a ship is underway, the ship rolls and/or pitches thus causing its satellite communications antenna to point in undesired directions. As such, corrections of the train and elevation pointing angles of the antenna are required. Each of the new pointing commands requires solution of a three-dimensional vector problem involving angles of ship's heading, roll, pitch, train, and elevation.

Three-axes pedestals, in their simplest form, include structural members, bearings, and drive means for supporting and positioning various rotating and pivoting structural members to align a tracking antenna about three axes, namely an azimuth axis, a cross-level axis, and an elevation axis. Antenna stabilization is achieved by activating drive means for each respective axis responsive to external stabilizing control signals from tilt sensors, accelerometers, angular rate sensors, Earth's magnetic field sensor, and/or other instruments useful for generating pedestal stabilizing control signals. Sensors, instruments, drivers and structure may be used for pedestal stabilization and antenna position control in otherwise conventional manners, such as those described by U.S. Pat. Nos. 9,466,889 to Patel, 9,000,995 to Blaney, 8,542,156 to Patel, and 5,419,521 to Matthews, the entire content of which patents is incorporated herein for all purposes by this reference.

While compactness in size and lightness in weight are of paramount importance for tracking antennae used on ships, the size and weight of the above-mentioned structural members, drivers, instruments and sensors can be significant. Accordingly, tracking antennae are often of such weight that the use of cranes and/or other lifting devices are necessary to safely install them, especially when such antennae are mast mounted. In order to overcome such disadvantages, various embodiments of the present invention modularize three-axes pedestals such that tracking antennae may be broken down into several assemblies of manageable weight allowing the tracking antennae to be installed without requiring the use of cranes and/or other lifting equipment.

Figure 1:
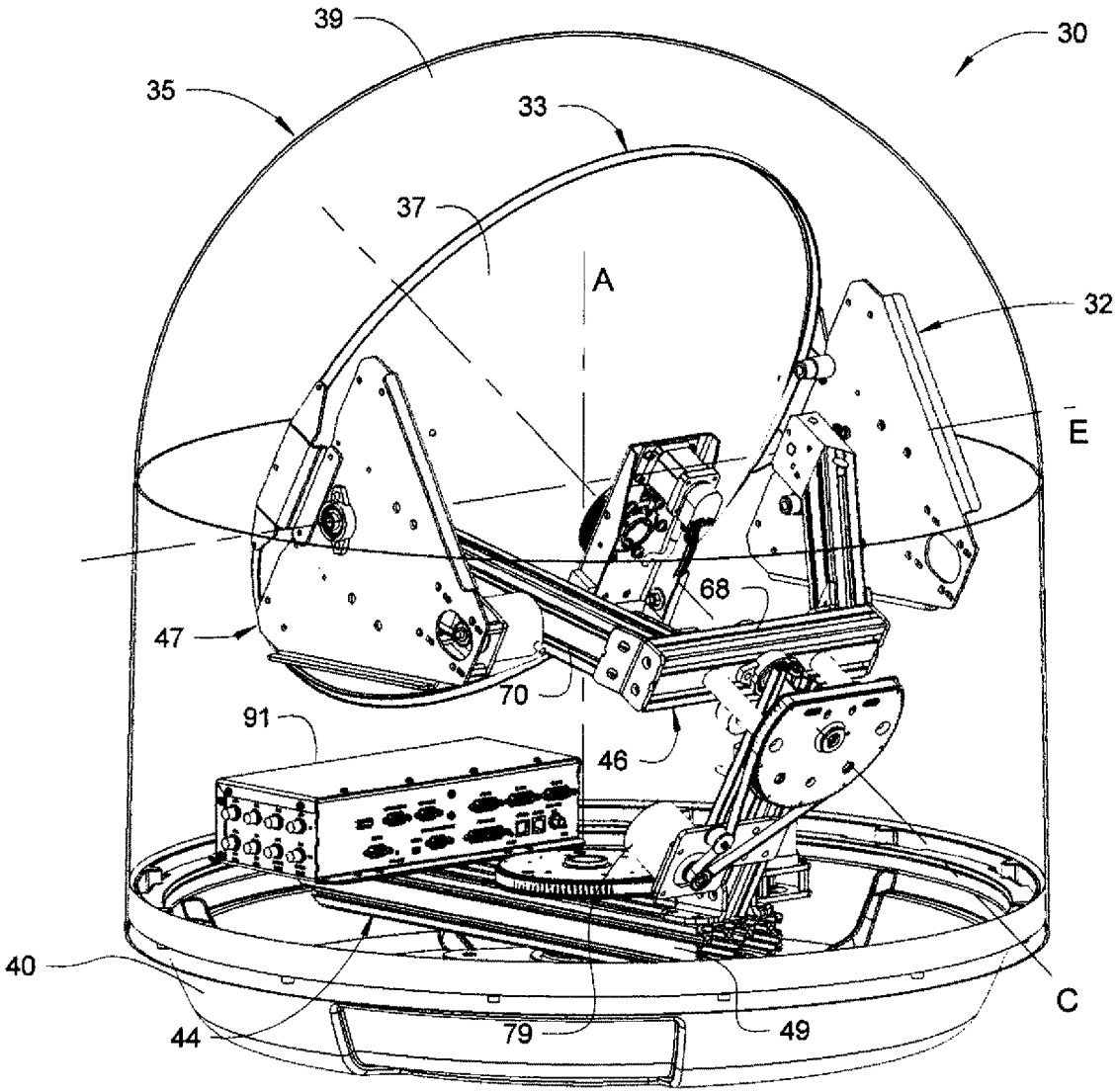
FIG. 1 is a perspective view of an exemplary tracking antenna system having a modular three-axes antenna pedestal in accordance with various aspects of the present invention.

Turning now to the drawings, wherein like components are designated by like reference numerals throughout the various figures, attention is directed to FIG. 1, which shows an exemplary antenna system 30 having a three-axes pedestal 32 supporting an antenna assembly 33 enclosed within a protective radome assembly 35.

The tracking antenna assembly generally includes an antenna reflector 37, one or more antenna feeds, and one or more corresponding RF modules. One will appreciate that the tracking antenna assembly may be a "receive-only" one-way antenna (e.g., TV-at-Sea applications), or it may a "transmit/receive" two-way antenna (e.g., VSAT applications). The tracking antenna assembly is housed within radome assembly 35, which generally includes a radome 39 and a radome base 40. The radome is configured to protect the tracking antenna assembly from a demanding marine environment, while the radome base is configured to securely mount the antenna system on a mast or other suitable portion of a ship or other vessel having a satellite communications terminal. One will appreciate that the antenna system of the present invention may also be suitable for non-marine application such as mounting on cell towers, buildings or other structures.

The three-axes antenna pedestal generally includes a base assembly 42, an azimuth frame 44 rotatably mounted on the base assembly to rotate about an azimuth axis A, a cross-level frame 46 pivotally mounted on the azimuth frame to pivot about a cross-level axis C, and an elevation frame 47 pivotally mounted on the cross-level frame to pivot about an elevation axis E. The elevation frame supports the tracking antenna assembly such that antenna reflector 37 can freely pivot and rotate about the elevation, cross-level and azimuth axes in order to accurately and continuously track the position of a satellite or other communications station.

In accordance with various embodiments of the present invention, various structural members of the azimuth, cross-level and elevation frames may be formed of modular components to simplify manufacturing, assembly, disassembly and reassembly of the three-axes pedestal. For example, extruded aluminum beams may be utilized to provide the basic structure of the cross-level and azimuth frames. Such configuration simplifies manufacturing by obviating the need for various weldments and castings. In the illustrated embodiments, extruded aluminum beams have 80/20 T-slotted profiles which allow assembly with various brackets and components by using T-nuts positioned within T-slots of the extruded aluminum beams in an otherwise conventional fashion. Also, 80/20 T-slotted aluminum beams are particularly well suited in such pedestal applications due to their strength-to-weight ratios. One will appreciate, however, that other suitable modular members may be utilized to provide a modular structure in accordance with the present invention.

As will become apparent below, the modular configuration of the three-axes pedestal 32 allows the ready disassembly of the cross-level frame (and all components supported thereon) from the lower portion of the azimuth frame (and the remaining components supported thereon). As such, antenna systems in accordance with various aspects of the present invention may be more easily installed because a user may first install (a) a first subassembly (including a lower portion of azimuth frame 44 mounted on radome base 40) on a mast or other suitable portion of a vessel, then install (b) a second subassembly (including the elevation frame 47 and cross-level frame 46 mounted on an upper portion of the azimuth frame) on the first assembly, and finally, install (c) radome 39 on radome base 40 to enclose everything and complete the installation. Installing the antenna assembly in separate subassemblies (a), (b) and (c) faciliates overall installation because the weight of each subassembly is signficantly less than the antenna system as a whole, and may thus be accomplished without the need of a crane or other lifting device.

Figure 2:
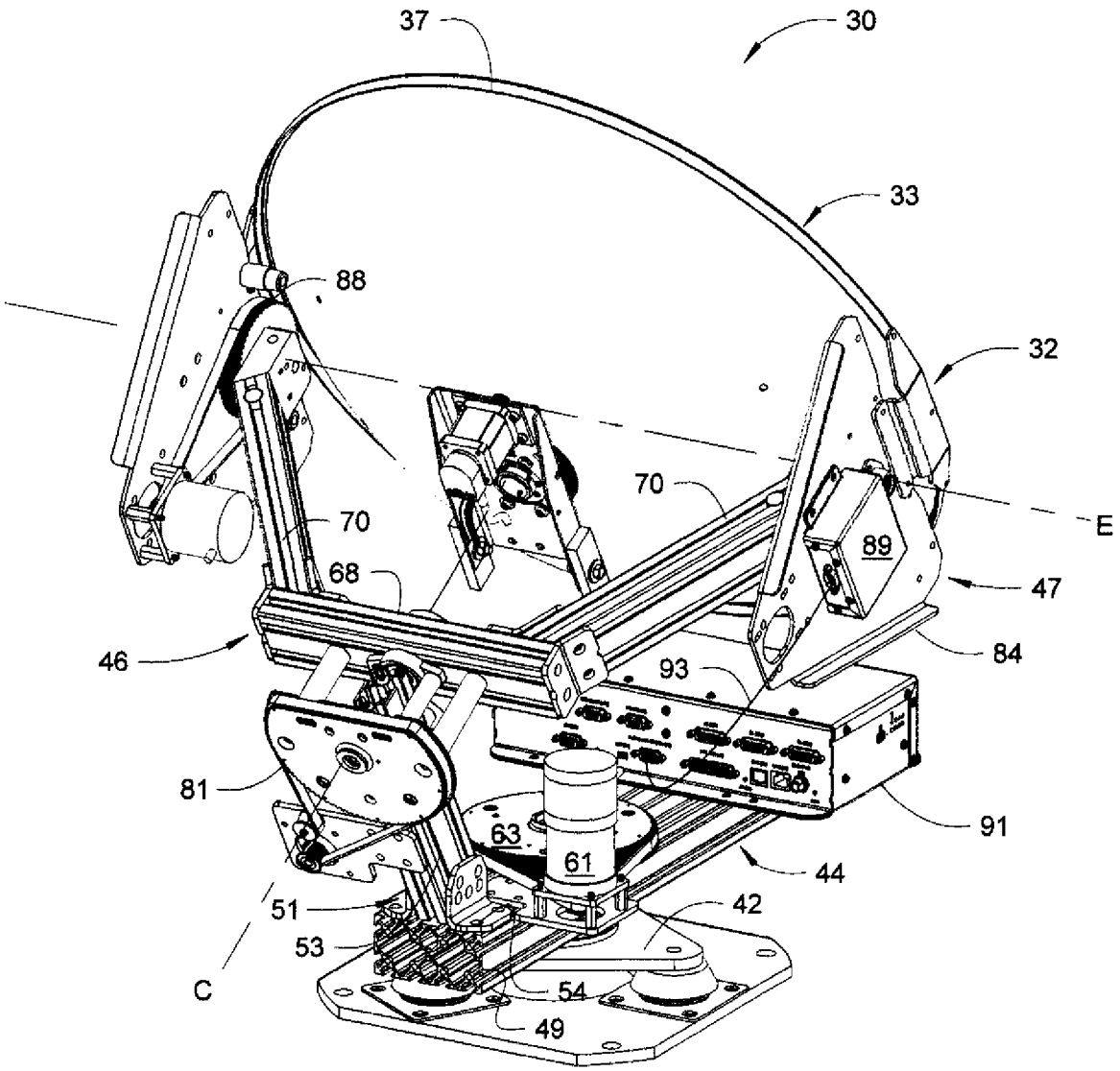
FIG. 2 is a perspective view of the modular three-axes pedestal antenna of FIG. 1 supporting an antenna assembly and various electronics.

With reference to FIG. 2, the azimuth frame includes an extruded substantially horizontal azimuth beam 49, a post 51 having an extruded upright beam in the form of inclined beam 53, and an azimuth bracket 54 releasably mounting the post to a rear end of the horizontal beam. One will appreciate that the azimuth beam preferably extends horizontally, but need not be horizontal—instead, the azimuth beam may be of other shapes and/or orientations provided that it rotate about azimuth axis A. In the illustrated embodiment, the azimuth bracket is in the form of two L-shaped flanges positioning lower sides of the post to an upper side of the azimuth beam. One will appreciate, however, that various means may be utilized to releasably secure the post to the azimuth beam, such as block having complementary recesses, channels and/or openings for receiving ends of the post and the azimuth beam, C-shaped flanges, rectangular flanges, and/or other suitable means. In the illustrated embodiment, the azimuth bracket has holes dimensioned and configured to correspond with T-slots of the extruded beams, through which bolts (e.g., Allen bolts shown in FIG. 9) may be inserted to threadedly engage with T-nuts located in the T-slots of the respective beams in an otherwise conventional manner to releasably secure the bracket to the respective beams, and thus releasably secure the post to the azimuth beam. One will appreciate that various threaded quick-release fastener(s) 45 may also be used to threadedly engage with T-nuts located in the T-slots of an extruded beam to secure the bracket to the extruded beam, such quick-release fasteners including, but not limited to, ratchet lever knobs (see, e.g., FIG. 5 and FIG. 9), quick-release cam levers, wing bolts, knob bolts, and other suitable means. While FIG. 5 and FIG. 9 each show only one quick-release fastener for the sake of simplicity and clarity, one will appreciate that that multiple fasteners may be used to secure the bracket to the respective beams.

Figure 6:
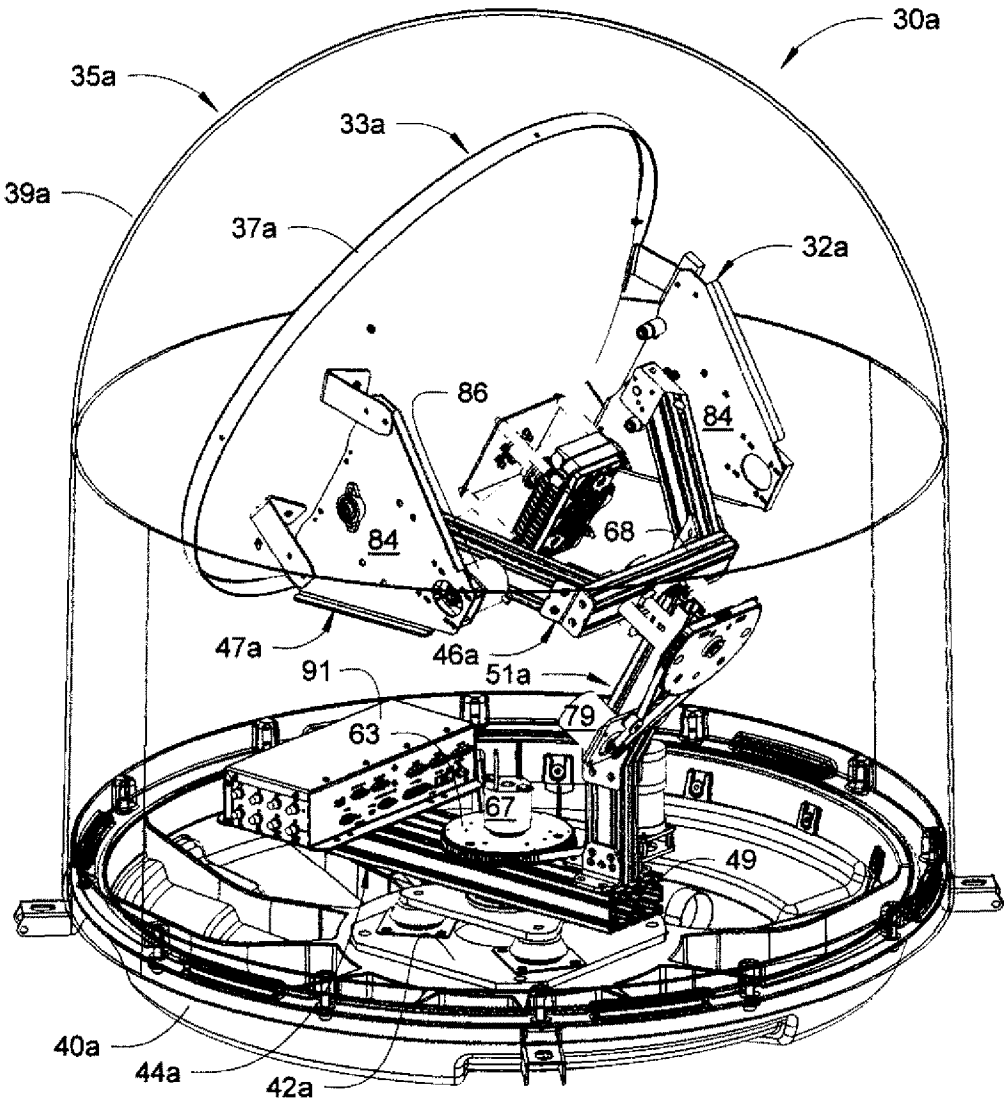
FIG. 6 is a perspective view of another exemplary tracking antenna system similar to that of FIG. 1, and having a modified modular three-axes antenna pedestal in accordance with various aspects of the present invention.
Figure 7:
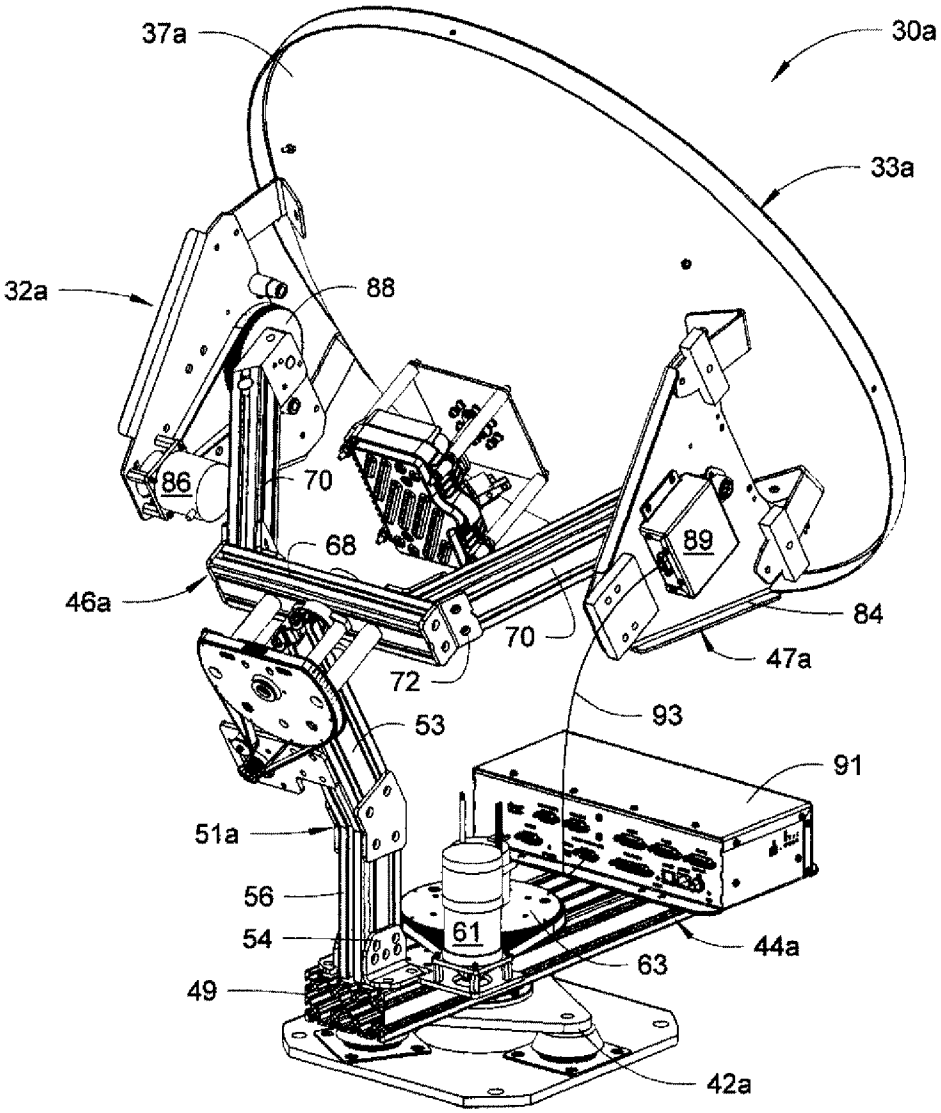
FIG. 7 is a perspective view of the modular three-axes pedestal antenna of FIG. 6 supporting an antenna assembly and various electronics.
Figure 8:
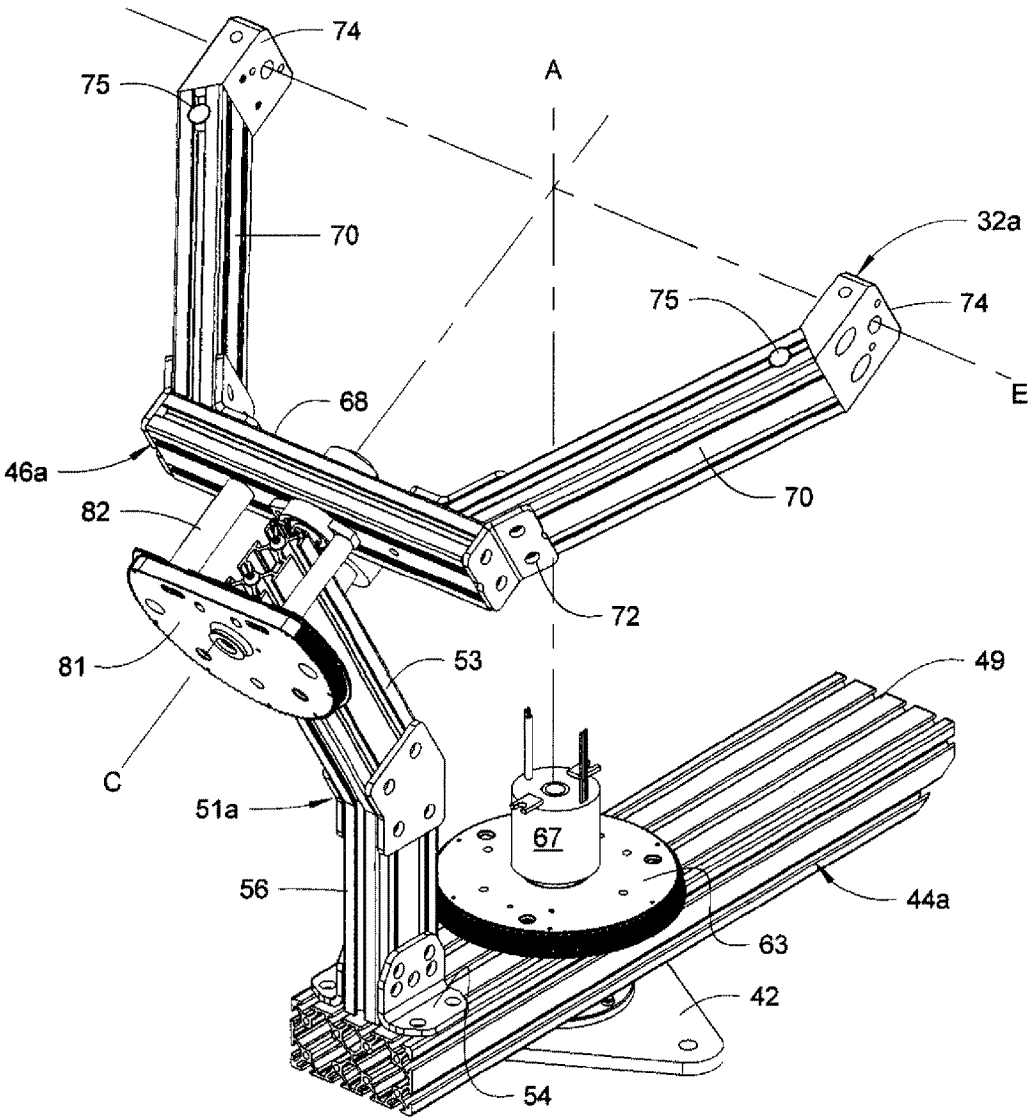
FIG. 8 is a perspective view of the primary structural members of the modular three-axes pedestal antenna of FIG. 6.

In other embodiments, post 51 may include a plurality of upright extruded beams, for example, an extruded vertical beam 56 interconnecting a lower end of the inclined beam 53 to the rear end of azimuth beam 49 of the azimuth frame, and a bracket 58 releasably mounting the vertical beam to the inclined beam, as shown in FIG. 6 through FIG. 8. Such a configuration allows for simple modification of the three-axes pedestal for use with various sized antenna assemblies.

For example, the three-axes pedestal illustrated in FIG. 1 is dimensioned and configured for use with a 24" (60 cm) antenna reflector, while the three-axes pedestal illustrated in FIG. 6 is dimensioned and configured for use with a 29.5" (75 cm) antenna reflector. In accordance with the modularization of the present invention, nearly all parts of three-axes pedestal 32 may be utilized to support both the 24" antenna reflector 37 and the 29.5" antenna reflector 37*a*. In the case of the latter, vertical beam 56 and post bracket 58 are utilized to elevate the cross-level frame 46 and the elevation frame 47 to provide the necessary vertical clearance of the larger antenna reflector. And by utilizing different reflector brackets, most other structural members may be used to support both antenna reflectors. For example, reflector brackets 60 may be used to secure a peripheral edge of antenna reflector 37 to elevation frame 47 in FIG. 1, and reflector brackets 60*a* may be used to secure an inner portion of antenna reflector 37*a* to elevation frame 47 in FIG. 6.

With reference to FIG. 2, an azimuth driver 61 rotates the azimuth frame relative to the base assembly about azimuth axis A. The azimuth driver is mounted on the azimuth frame and includes an azimuth motor driving an azimuth belt entrained around an azimuth gear 63 rotationally affixed to base assembly 42 by an azimuth spindle 65. The azimuth spindle has an opening that provides a pass-through for a rotary joint/slip ring or other suitable means cable access to components mounted on the pedestal (see, e.g., rotary joint/slip ring 67 in FIG. 8). For example, a coaxial rotary joint provides for a convenient method for carrying communication signals, antenna stabilization and position command and status information, and electrical power, all of which may be multiplexed on a single coaxial cable. With this arrangement three-axes pedestal 32 can accommodate unlimited ship turning maneuvers.

Figure 9:
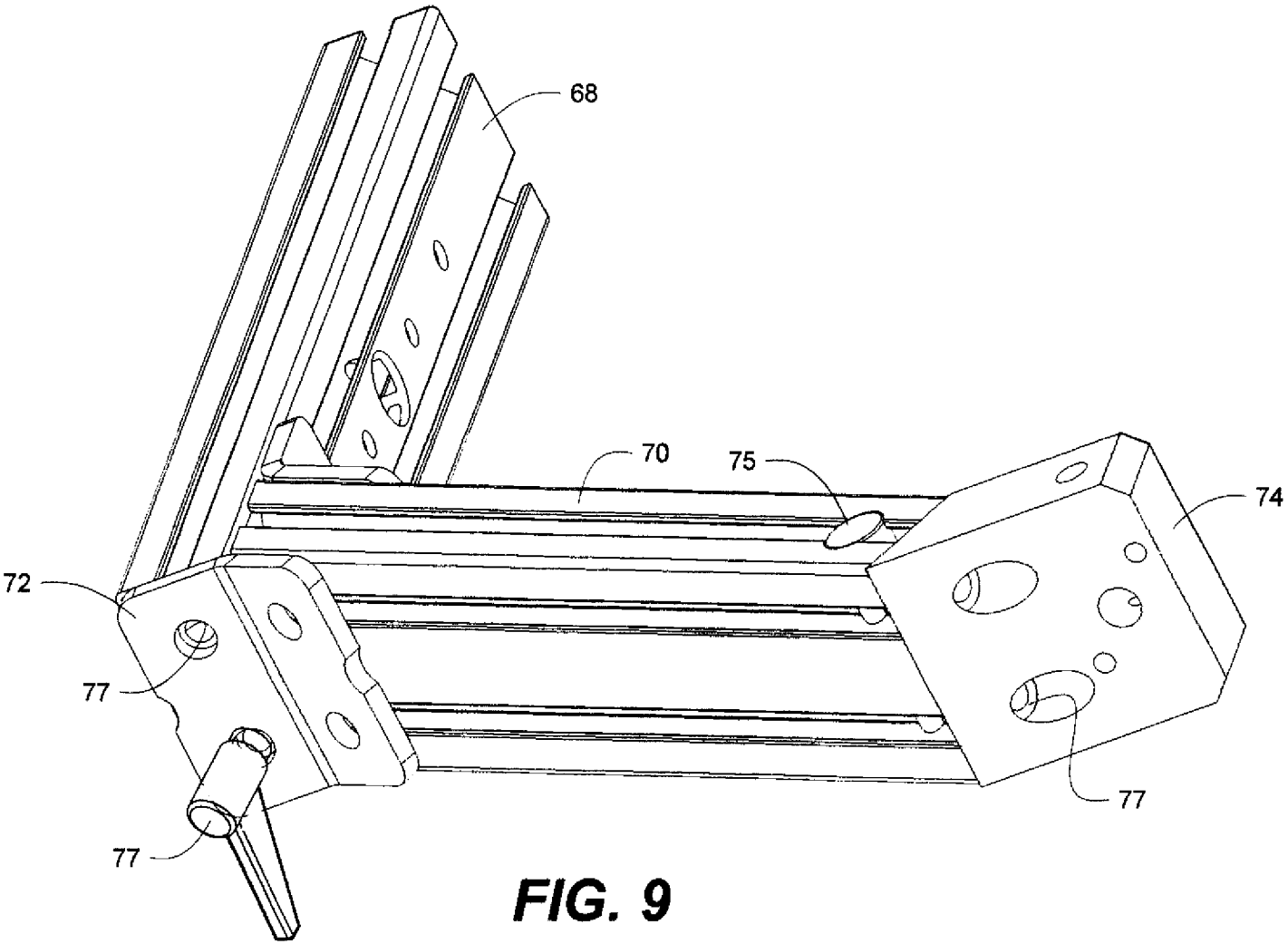
FIG. 9 is a perspective view of a diverging arm and a bearing block of the modular three-axes pedestal in in accordance with various aspects of the present invention.

With continued reference to FIG. 2, cross-level frame 46 includes a cross-level member 68 and a pair of extruded diverging arms 70 extending from opposing ends of the cross beam. In the illustrated embodiment, the cross-level member is in the form of an extruded cross beam, however, one will appreciate that the member may take various forms, such as the ones described below. A pair of cross-level brackets 72 releasably secures the diverging arms to the opposing ends of the cross beam. The cross-level brackets are V-shaped brackets that are similar to the L-shaped azimuth brackets described above, and can be similarly secured to their respective beams. Similarly, one will appreciate that various means may be utilized to releasably secure the diverging arms to the cross beam. Finally, a pair of bearing blocks 74 are mounted on respective terminal ends of diverging arms 70 to pivotally receive elevation frame 47 about elevation axis E. The bearing blocks are releasably secured to the terminal ends of the diverging arms. With reference to FIG. 9, each diverging arm 70 includes a bore receiving a traditional truss rod or barrel anchor nut 75, and each bearing block 74 includes one or more counter bores receiving a fastener 77, such as an Allen bolt or the like, that threadedly engages the anchor nut in an otherwise conventional manner to releasably secure the bearing block to the diverging arm.

Figure 3:
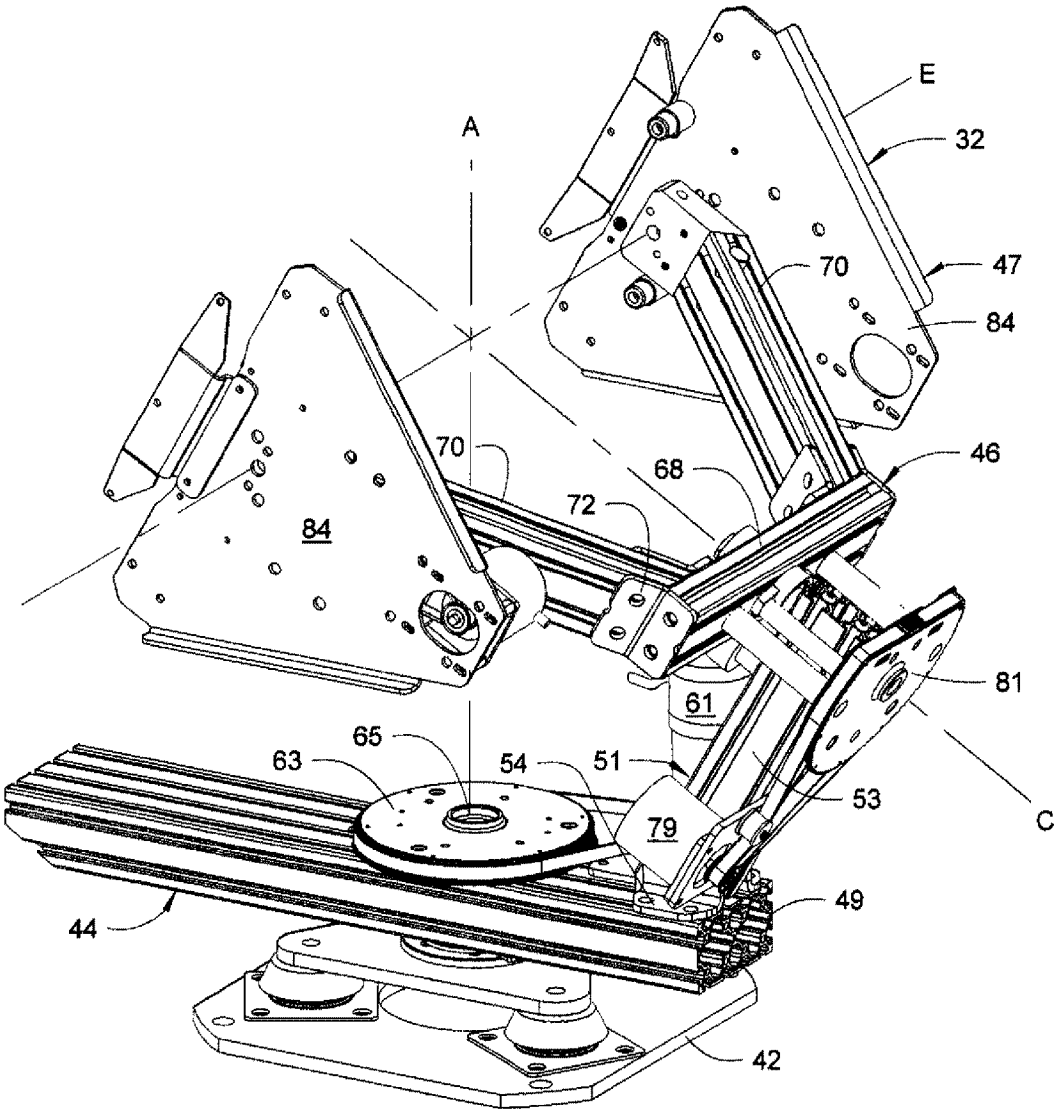
FIG. 3 is a perspective view of the modular three-axes pedestal antenna of FIG. 1 without the antenna assembly and associated electronics.
Figure 4:
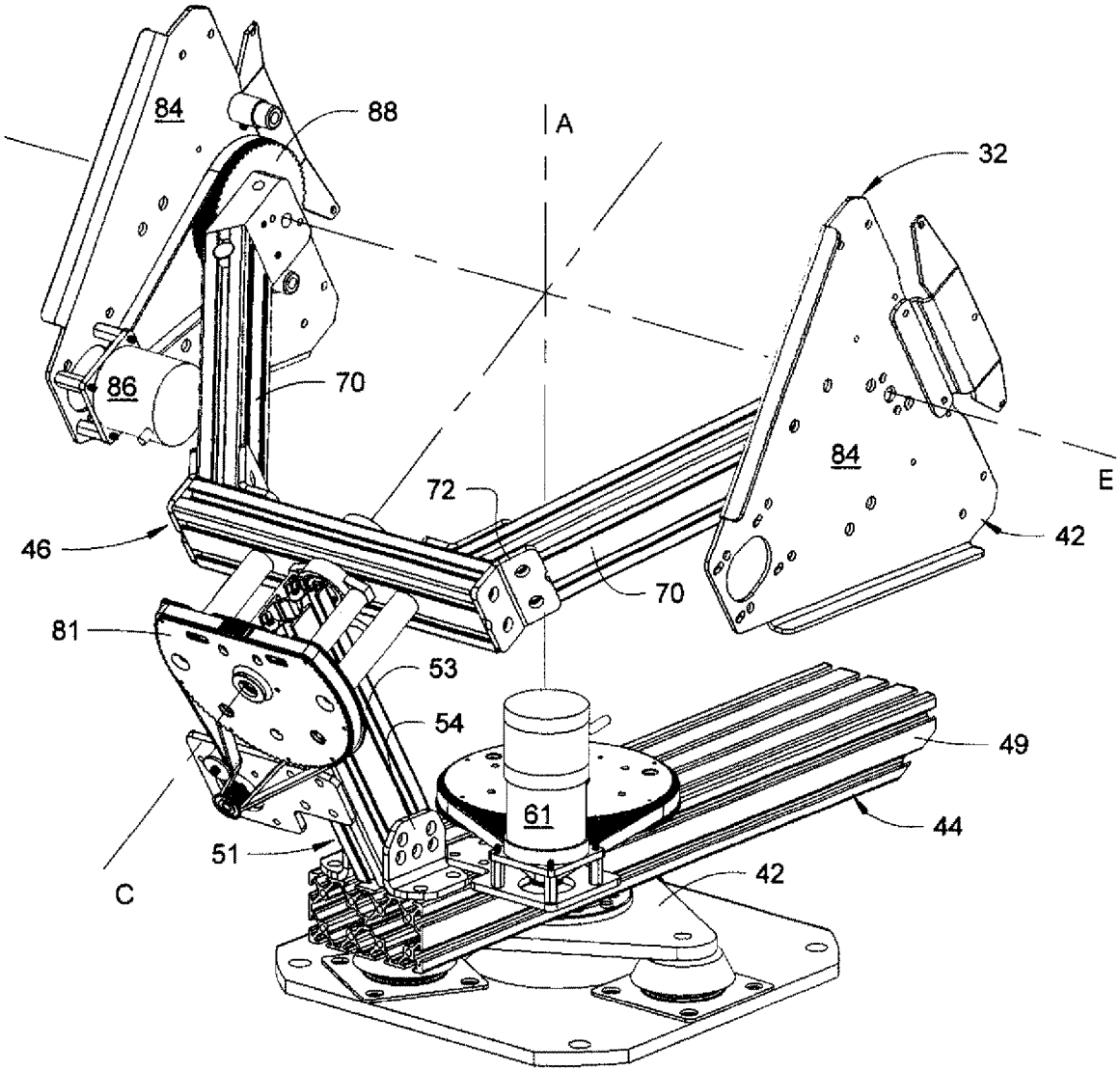
FIG. 4 is another perspective view of the modular three-axes pedestal antenna of FIG. 1 without the antenna assembly and associated electronics.

With reference to FIG. 3, a cross-level driver 79 pivots the cross-level frame relative to the azimuth frame about cross-level axis C. The cross-level driver is mounted on post 51 of the azimuth frame and includes a cross-level motor driving a cross-level belt entrained around a cross-level gear 81 rotationally affixed to the cross-level frame 46. In the illustrated embodiment, the cross-level gear is rotationally affixed to cross beam 68 via a pair of fixing members 82 that rigidly interconnect the cross-level gear and the cross beam. In the illustrated embodiment, the fixing member includes a hollow sleeve and a bolt that extends through the cross-level gear, sleeve and cross beam. One will appreciate that other suitable means may be utilized to rotationally affix the cross-level gear to the cross beam while allowing the cross beam to pivot with respect to the post.

With reference to FIG. 2, the elevation frame includes a pair of elevation brackets 84 that pivotally support the tracking antenna assembly 33 on the cross-level frame to pivot about elevation axis E. The elevation brackets may be formed of an aluminum plate and may include various apertures and/or flanges that facilitate the mounting of various components thereon.

An elevation driver 86 is mounted on the elevation frame 47 and pivots the elevation frame relative to the cross-level frame 46. The elevation driver includes an elevation motor driving an elevation belt entrained around an elevation gear 88 rotationally affixed to the cross-level frame.

In contrast to prior systems, various embodiments of the present invention include a motion platform assembly 89 is mounted on the elevation frame 47 and an electronics assembly 91 mounted on azimuth frame 44. The motion platform assembly moves with the elevation frame and antenna assembly 33, and is configured to sense position and movement the antenna assembly. The electronics assembly is mounted on the azimuth frame and includes an integrated pedestal control unit (PCU) for processing signals from the motion platform to control the azimuth, cross-level and elevation drivers for moving the tracking antenna about the azimuth, cross-level and elevation axes. In accordance with various embodiments of the present invention, such configuration reduces the componentry mounted on the elevation frame, and thus reduces the weight of the elevation frame. Not only does this reduce the need to counterweight the elevation frame, it facilitates removal of elevation frame 47, cross-level frame 46 and post 51 (and components supported thereon) together as a subassembly from azimuth beam 49 (and the remaining components supported thereon), and thus facilitates installation of the antenna system as discussed above.

Motion platform assembly 89 includes a three-axes gravity accelerometer assembly and a three-axes angular rate sensor assembly for accurately sensing the position and movement of elevation frame 47 (and thus the position and movement of antenna reflector 37). One will appreciate that the accelerometer assembly may include one 3-axes accelerometer, two 2-axis accelerometers, three 1-axis accelerometers, or a combination thereof to accurately sense the orientation of the antenna assembly relative to the earth's gravity vector. The gravity accelerometers may be ADIS16209 accelerometers provided by Analog Devices of Norwood, Mass. One will appreciate, however, that other micro-electro-mechanical system (MEMS) accelerometer and/or other suitable accelerometers may be utilized.

The motion platform assembly also includes a three-axes angular rate sensor assembly. For example, three orthogonally mounted angular rate sensors may be disposed within the motion platform assembly for sensing motion about orthogonal X, Y and Z-axis of the elevation frame (and thus the motion of the antenna assembly). The angular rate sensors may be CRS03 angular sensors provided by Silicon Sensing Systems Limited of Hyogo, Japan. One will appreciate, however, that other suitable sensors may be utilized.

The PCU of the electronics assembly determines the actual position of the elevation frame (and thus the actual position of the antenna assembly) based upon signals output from motion platform assembly. The electronics assembly may further include various electronics that receive and process signals from the antenna assembly and/or communicate with the ship's satellite communications station.

A removable communications line 93 interconnects motion platform assembly 89 and electronics assembly 91. Any suitable communications line may be used including, but not limited to, a serial bus, a coaxial cable, an Ethernet cable, and/or other suitable means.

In some embodiments, the antenna system may be configured for low pointing applications utilizing stepper motors (e.g., TVRO applications), in which case the motion platform can be incorporated into electronics assembly 91. Such configurations may not as precise as the elevation-frame mounted motion platforms described above, but such configurations may provide sufficient granularity for low pointing applications.

Figure 5:
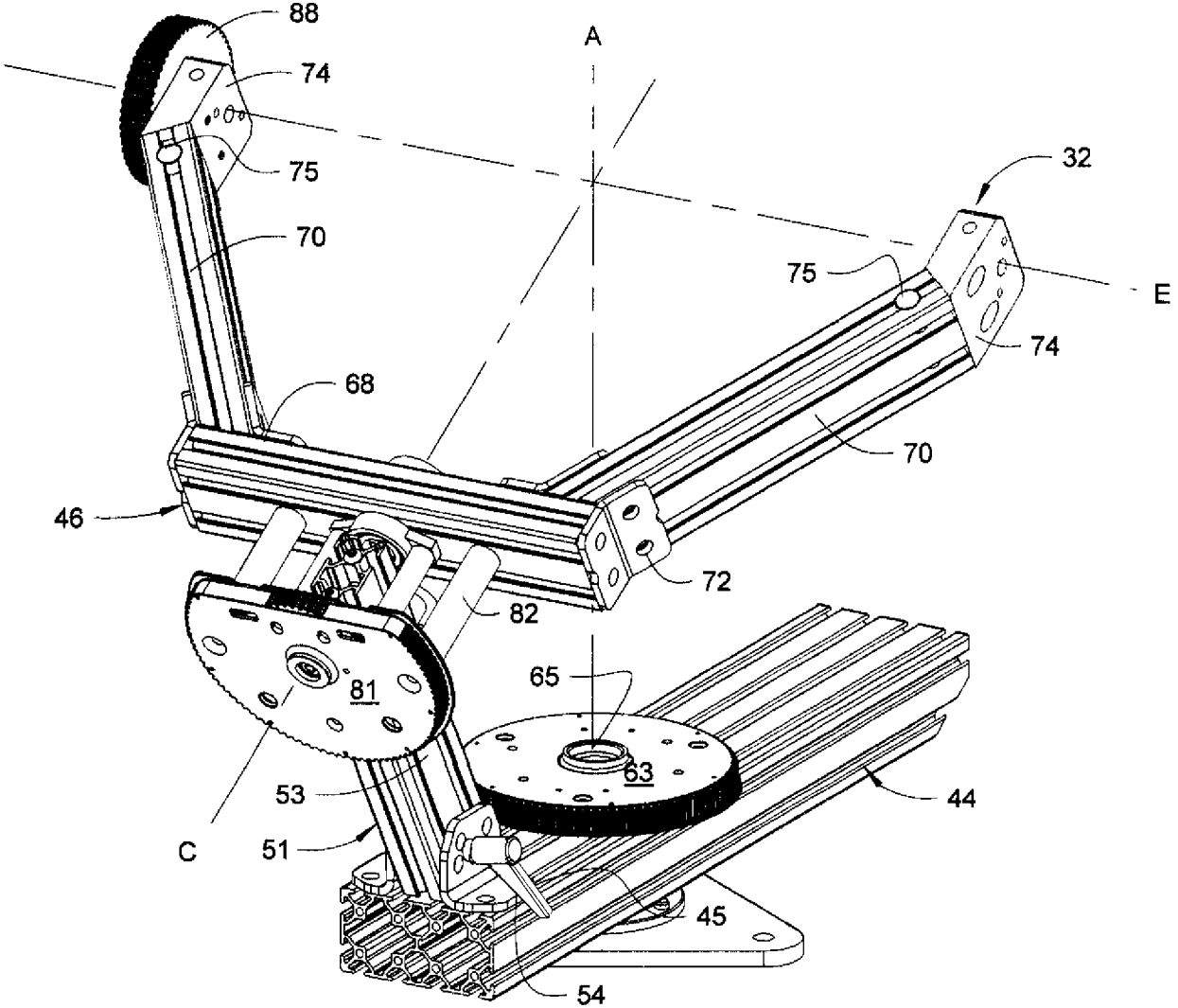
FIG. 5 is a perspective view of the primary structural members of the modular three-axes pedestal antenna of FIG. 1.
Figure 11:
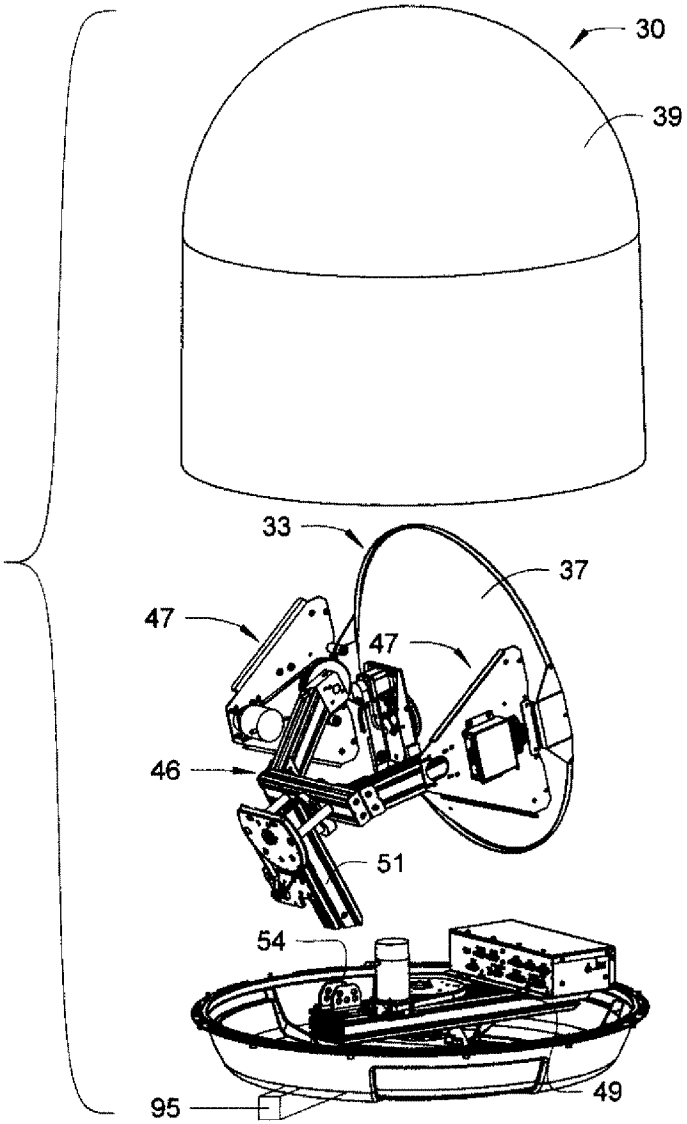
FIG. 11 is another perspective view of the exemplary tracking antenna system of FIG. 1 shown broken down into three subassemblies to facilitate installation on a mast or other structure.
Figure 10:
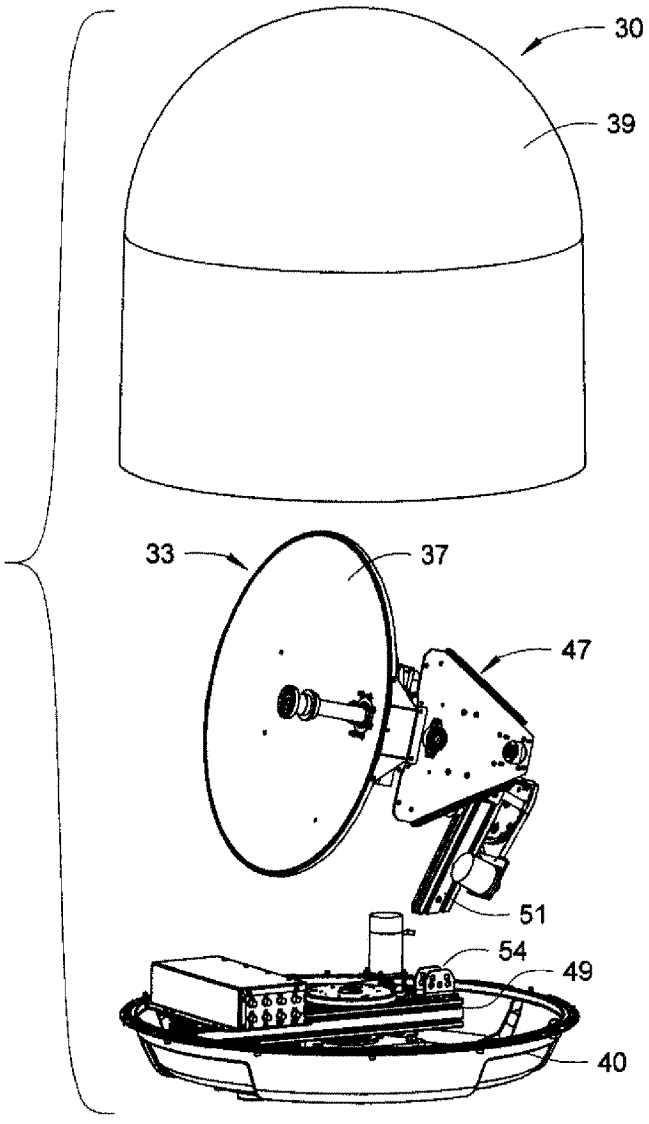
FIG. 10 is a perspective view of the exemplary tracking antenna system of FIG. 1 shown broken down into three subassemblies to facilitate installation on a mast or other structure.

One exemplary method of installing an antenna system having a three-axis pedestal in accordance with the present invention can now be described. As noted above, tracking antennae are often of such weight that the use of cranes and/or other lifting devices are necessary to safely install them. In accordance with various aspects of the present invention, antenna system 30 may be broken down into three subassemblies of manageable weight (see, e.g., FIG. 10 and FIG. 11), each preferably under 40 lbs. to meet OSHA-safe lifting weight requirements. In particular, antenna system 30 may be broken down as follows to provide three subassemblies, each of which is under 40 lbs. and can be easily transported and mounted without cranes and/or other lifting equipment:

Subassembly (1) including radome 39 removed from radome base 40;

Subassembly (2) formed by detaching and removing post 51 from azimuth beam 49 by uncoupling azimuth bracket 54 from the post and/or the azimuth beam (e.g., by loosening/removing lever knob(s) 45 shown in FIG. 5), in which subassembly (2) includes the detached post 51 along with cross-level frame 46, elevation frame 47, antenna reflector 37, and componentry mounted thereon; and Subassembly (3) includes the remaining components including azimuth beam 49, base assembly 42, radome base 40, and remaining componentry mounted thereon.

As such, subassembly (3) can be lifted, positioned, and installed in place (e.g., on a mast or other installation site 95) without need for cranes. Subassembly (2) may then be lifted, positioned and mounted on subassembly (2) by reattaching azimuth bracket 54 to post 51 and/or azimuth beam 49. Finally, subassembly (3), that is, radome 39 may be lifted, positioned and mounted radome base 40 thus enclosing tree-axes pedestal 32 and antenna assembly 33 and associated componentry within the radome assembly 35 to complete the installation. Such assembly beneficially avoids the need for expensive cranes at the installation site and thus simplifies logistics coordination. This also provides antenna dealers more flexibility to work in remote area by facilitating installation.

Figure 12:
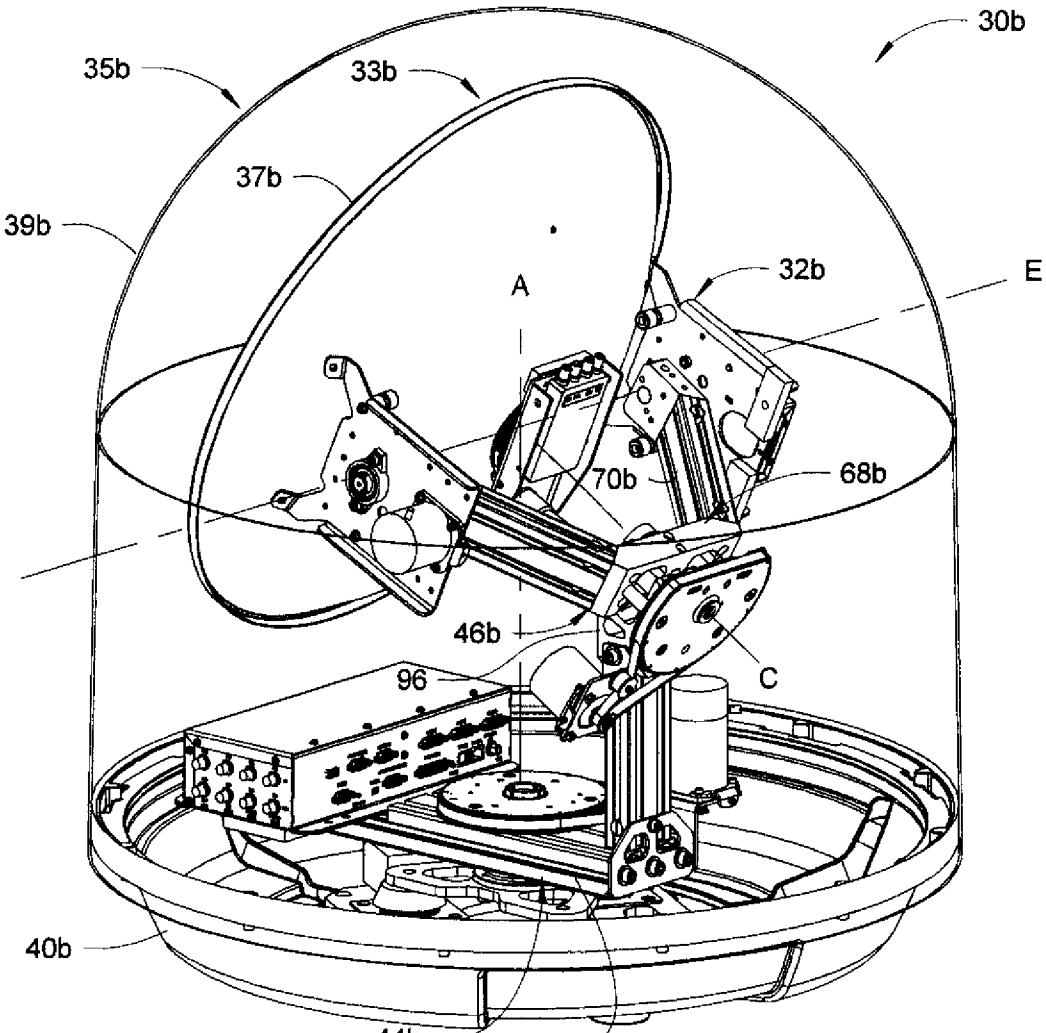
FIG. 12 is a perspective view of another exemplary tracking antenna system similar to that of FIG. 1, and having a modified modular three-axes antenna pedestal in accordance with various aspects of the present invention.
Figure 13:
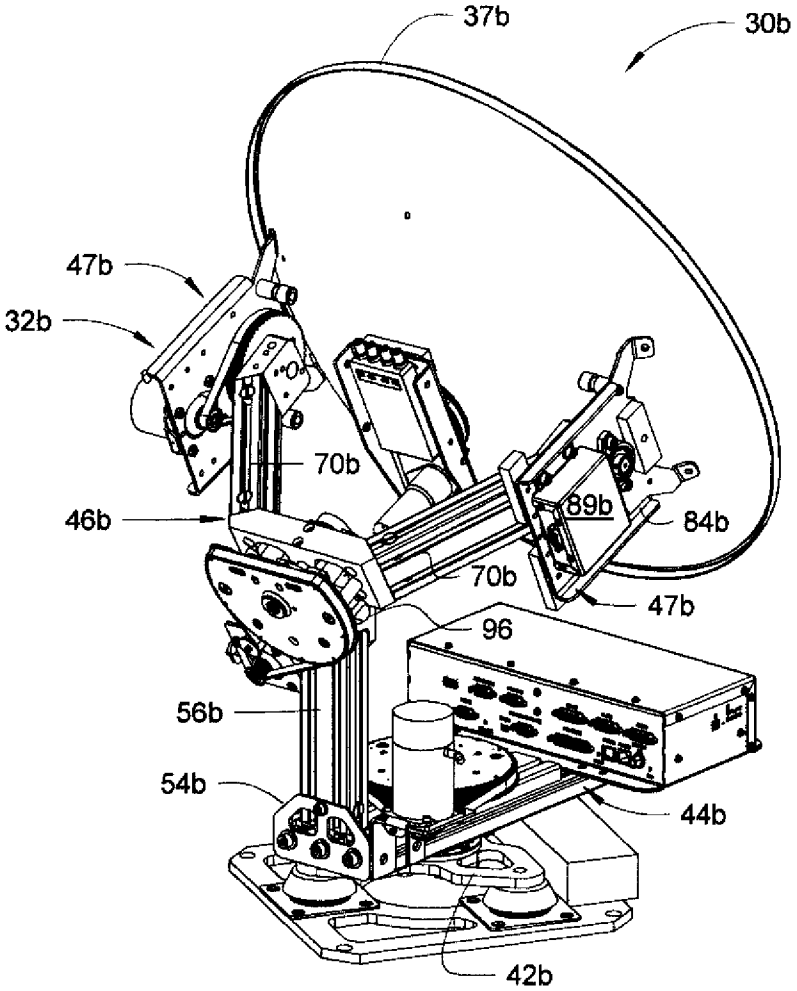
FIG. 13 is a perspective view of the modular three-axes pedestal antenna of FIG. 12 supporting an antenna assembly and various electronics.
Figure 14:
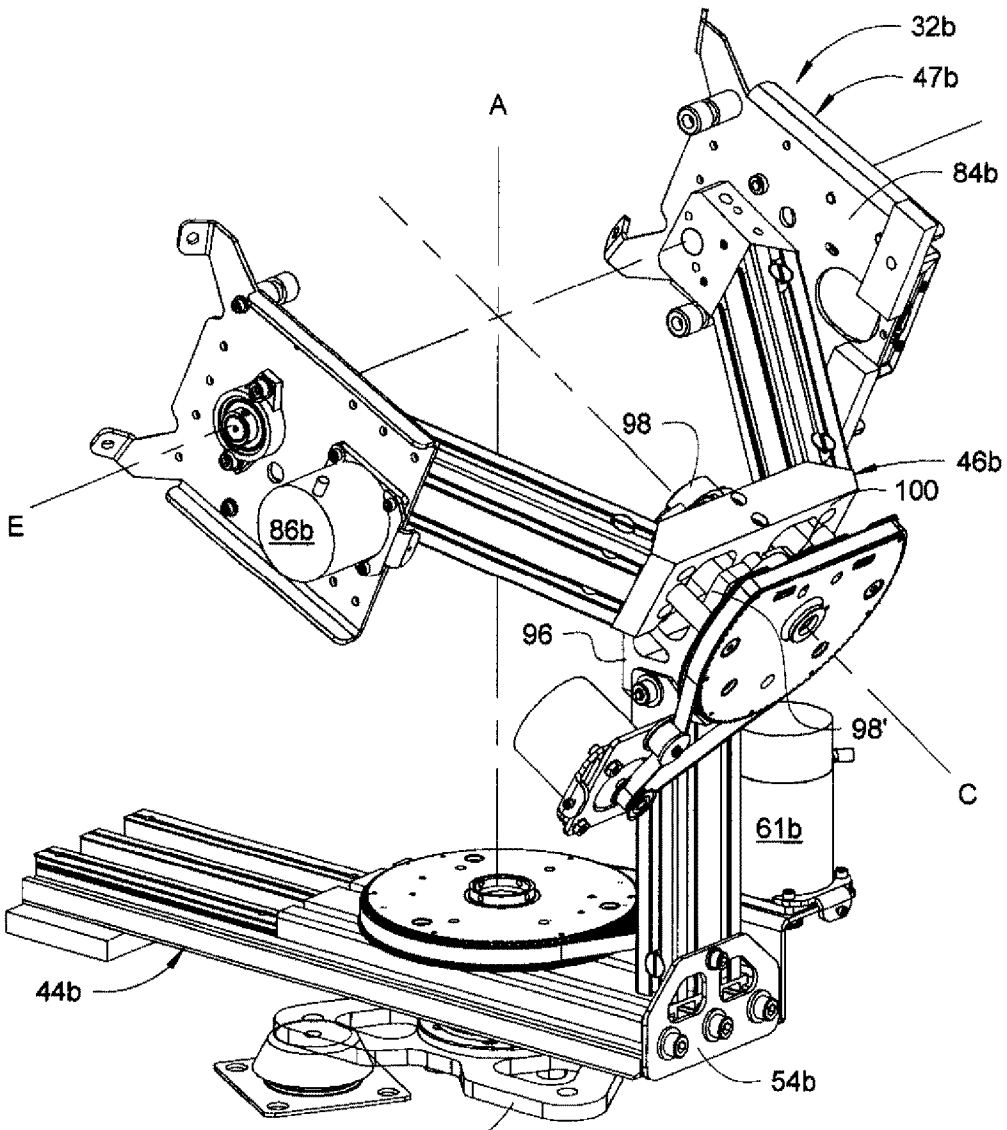
FIG. 14 is a perspective view of the primary structural members of the modular three-axes pedestal antenna of FIG. 12.

With reference to FIG. 12 through FIG. 14, various embodiments may include azimuth frames, posts and/or cross-level frames of other configurations.

For example, the post 51*b* may include a single upright beam in the form of vertical beam 56*b*. In such configurations, azimuth bracket 54*b* may be in the form of a flat bracket positioning a lower side of the post to the end of azimuth beam 49*b*. In the illustrated embodiment, the azimuth bracket has holes dimensioned and configured to correspond with T-slots of the extruded beams, through which bolts may be inserted to threadedly engage with T-nuts located in the T-slots of the respective beams in an otherwise conventional manner to releasably secure the bracket to the respective beams, and thus releasably secure the post to the azimuth beam.

Also, post 51*b* may have a pivot mount 96 supported at the top of the single upright post (e.g., vertical beam 56*b* shown in FIG. 13 and FIG. 14). One will appreciate that such a pivot mount may similarly supported at the top of an inclined beam of the type shown in FIG. 1 or FIG. 6.

As shown in FIG. 13 and FIG. 14, pivot mount 96 may is readily secured to the top of the upright beam and defines the cross-level axis C. Preferably, the pivot mount has a yoke-like configuration in which cross-level member 68*b* is received between front and rear pivot arms 98, 98', with the cross-level axis extending through both arms 98, 98' and the cross-level member. One will appreciate that the pivot mount may be formed by various means including CNC milling, casting, 3D printing and/or other suitable fabrication means.

With continued reference to FIG. 13 and FIG. 14, cross-level frame 46*b* includes a cross-level member 68*b* in the form of a hub from which a pair of extruded diverging arms 70*b* extend from opposing ends thereof. The diverging arms may be releasably secured to the hub 68*b*. For example, each diverging arm may include a bore receiving a traditional truss rod or barrel anchor nut 75*b*, and the hub may include one or more counter bores 100 receiving a fastener, such as an Allen bolt or the like, that threadedly engages the anchor nut in an otherwise conventional manner to releasably secure the diverging arms to the cross-level member 68*b*.

An advantage of the hub-like configuration of cross-level member 68*b* is a more compact design that allows the bearing blocks 74*b* to be spaced further in relative to the perimeter of antenna reflector 37*b*. Such compactness allows additional componentry (e.g., elevation driver 86*b*) to be mounted on the outside of elevation brackets 84*b*, which in turn, leads to greater serviceability of such componentry.

For convenience in explanation and accurate definition in the appended claims, the terms "upper", "lower", and etc. are used to describe features of the exemplary embodiments with reference to the positions of such features as displayed in the figures.

In many respects, various modified features of the various figures resemble those of preceding features and the same reference numerals followed by subscripts "a" and "b" designate corresponding parts.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A modular three-axes antenna pedestal for supporting a tracking antenna, said modular three-axes antenna pedestal comprising:

a base assembly;

an azimuth frame rotatably mounted on the base assembly to rotate about an azimuth axis, the azimuth frame including an extruded azimuth beam, a post having an extruded upright beam, and an azimuth bracket releasably mounting the post to a rear end of the azimuth beam;

a cross-level frame pivotally mounted on the azimuth frame to pivot about a cross-level axis;

an elevation frame supporting the tracking antenna and pivotally mounted on the cross-level frame to pivot about an elevation axis;

a motion platform assembly mounted on the elevation frame to move with the elevation frame and the tracking antenna, wherein the motion platform senses the position and movement the antenna assembly with respect to the earth's gravity vector; and a pedestal control unit (PCU) mounted on the azimuth frame for processing signals from the motion platform to control movement of the tracking antenna about the azimuth, cross-level and elevation axis.

2. A modular three-axes antenna pedestal according to claim 1, wherein a quick-release fastener releasably secures the azimuth bracket to one of the post and the azimuth beam.

3. A modular three-axes antenna pedestal according to claim 1, wherein the cross-level frame includes an extruded cross beam.

4. A modular three-axes antenna pedestal according to claim 3, wherein the cross-level frame further comprises a pair of extruded diverging arms extending from opposing ends of the cross beam, a pair of cross-level brackets releasably securing the diverging arms to the opposing ends of the cross beam, a pair of bearing blocks mounted on respective terminal ends of the diverging arms, the bearing blocks being releasably secured to the terminal ends of the diverging arms.

5. A modular three-axes antenna pedestal according to claim 1, wherein the cross-level frame includes a hub, a pair of extruded diverging arms extending from opposing ends of the hub, and a pair of bearing blocks mounted on respective terminal ends of the diverging arms.

6. A modular three-axes antenna pedestal according to claim 1, further comprising:

an azimuth driver for rotating the azimuth frame relative to the base assembly, the azimuth driver being mounted on the azimuth frame, the azimuth driver including an azimuth motor driving an azimuth belt entrained around an azimuth gear rotationally affixed to the base assembly;

a cross-level driver for pivoting the cross-level frame relative to the azimuth frame, the cross-level driver being mounted on the post of the azimuth frame, the cross-level driver including a cross-level motor driving a cross-level belt entrained around a cross-level gear rotationally affixed to the cross-level frame; and an elevation driver for pivoting the elevation frame relative to the cross-level frame, the elevation driver being mounted on the elevation frame, the elevation driver including an elevation motor driving an elevation belt entrained around an elevation gear rotationally affixed to the cross-level frame.

7. A modular three-axes antenna pedestal according to claim 6, wherein the PCU processes signals from the motion platform to control the azimuth, cross-level and elevation drivers for controlling movement of the tracking antenna about the azimuth, cross-level and elevation axis.

8. A modular three-axes antenna pedestal according to claim 1, further comprising a removable communications line for interconnecting the motion platform and the electronics assembly.

9. A modular three-axes antenna pedestal according to claim 1, wherein the post further comprises an extruded inclined beam, wherein the upright beam is vertical and interconnects a lower end of the inclined beam to the rear end of the azimuth beam of the azimuth frame, and a post bracket releasably mounting the upright beam to the inclined beam.

10. A modular three-axes antenna pedestal for supporting a tracking antenna, said modular three-axes antenna pedestal comprising:

a base assembly;

an azimuth frame rotatably mounted on the base assembly to rotate about an azimuth axis, the azimuth frame including an azimuth beam, a post having an upright beam, and an azimuth bracket releasably mounting the post to a rear end of the azimuth beam;

an azimuth driver for rotating the azimuth frame relative to the base assembly, the azimuth driver being mounted on the azimuth frame, the azimuth driver including an azimuth motor driving an azimuth belt entrained around an azimuth gear rotationally affixed to the base assembly;

a cross-level frame pivotally mounted on the azimuth frame to pivot about a cross-level axis, the cross-level frame including a cross-level member, a pair of diverging arms extending from opposing ends of the cross-level member;

a cross-level driver for pivoting the cross-level frame relative to the azimuth frame, the cross-level driver being mounted on the post of the azimuth frame, the cross-level driver including a cross-level motor driving a cross-level belt entrained around a cross-level gear rotationally affixed to the cross-level frame;

an elevation frame supporting the tracking antenna and pivotally mounted on the cross-level frame to pivot about an elevation axis; and an elevation driver for pivoting the elevation frame relative to the cross-level frame, the elevation driver being mounted on the elevation frame, the elevation driver including an elevation motor driving an elevation belt entrained around an elevation gear rotationally affixed to the cross-level frame.

11. A modular three-axes antenna pedestal according to claim 10, wherein a quick-release fastener releasably secures the azimuth bracket to one of the post and the azimuth beam.

12. A modular three-axes antenna pedestal according to claim 10, wherein the azimuth beam is an extruded azimuth beam, and the upright beam is an extruded upright beam.

13. A modular three-axes antenna pedestal according to claim 10, wherein the post further comprises an upright beam, wherein the upright beam is substantially vertical and interconnects a lower end of the inclined beam to the rear end of the azimuth beam of the azimuth frame, and a post bracket releasably mounting the upright beam to the inclined beam.

14. A modular three-axes antenna pedestal according to claim 13, wherein the vertical beam is an extruded vertical beam.

15. A modular three-axes antenna pedestal according to claim 10, wherein the cross-level member is an extruded cross beam, and the pair of diverging arms are extruded diverging arms.

16. A modular three-axes antenna pedestal according to claim 15, wherein the cross-level frame further comprises a pair of cross-level brackets releasably securing the diverging arms to the opposing ends of the cross beam.

17. A modular three-axes antenna pedestal according to claim 16, wherein the cross-level frame further comprises a pair of bearing blocks mounted on respective terminal ends of the diverging arms, the bearing blocks being releasably secured to the terminal ends of the diverging arms.

18. A modular three-axes antenna pedestal according to claim 10, further comprising:

a motion platform assembly mounted on the elevation frame to move with the elevation frame and the tracking antenna, wherein the motion platform senses the position and movement the antenna assembly with respect to the earth's gravity vector; and a pedestal control unit (PCU) mounted on the azimuth frame for processing signals from the motion platform to control movement of the tracking antenna about the azimuth, cross-level and elevation axis.

19. A modular three-axes antenna pedestal according to claim 10, wherein the PCU processes signals from the motion platform to control the azimuth, cross-level and elevation drivers for controlling movement of the tracking antenna about the azimuth, cross-level and elevation axis.

20. A modular three-axes antenna pedestal according to claim 10, further comprising a removable communications line for interconnecting the motion platform and the electronics assembly.

21. A method of installing a tracking antenna including a radome removably mounted on a radome base and a modular three-axes antenna pedestal also mounted on the radome base, the modular three-axes antenna pedestal comprising: an azimuth frame rotatably mounted on the radome base to rotate about an azimuth axis, the azimuth frame including an azimuth beam, a post releasably mounting to the azimuth beam; an azimuth driver for rotating the azimuth frame relative to the radome base, the azimuth driver being mounted on the azimuth frame, the azimuth driver including an azimuth motor driving an azimuth belt entrained around an azimuth gear rotationally affixed with respect to the radome base; a cross-level frame pivotally mounted on the azimuth frame to pivot about a cross-level axis, the cross-level frame; a cross-level driver for pivoting the cross-level frame relative to the azimuth frame, the cross-level driver being mounted on the post of the azimuth frame, the cross-level driver including a cross-level motor driving a cross-level belt entrained around a cross-level gear rotationally affixed to the cross-level frame; an elevation frame supporting the tracking antenna and pivotally mounted on the cross-level frame to pivot about an elevation axis; and an elevation driver for pivoting the elevation frame relative to the cross-level frame, the elevation driver being mounted on the elevation frame, the elevation driver including an elevation motor driving an elevation belt entrained around an elevation gear rotationally affixed to the cross-level frame, the method comprising:

removing the radome from the radome base;

releasing the post from the azimuth beam, and removing the post, cross-level frame, elevation frame and tracking antenna from the radome base;

mounting the radome base on an installation site;

mounting the post on the azimuth beam at the installation site, thereby mounting the post, cross-level frame, elevation frame and tracking antenna on the radome base; and mounting the radome on the radome base at the installation site.

* * * * *